US005412358A

United States Patent [19]

Hirai et al.

[11] Patent Number: 5,412,358

[45] Date of Patent: May 2, 1995

[54] LAYERED STRIPLINE FILTER

[75] Inventors: Takami Hirai, Nishikamo; Shinsuke Yano, Nagoya, both of Japan

[73] Assignee: NGK Insulators, Ltd., Japan

[21] Appl. No.: 24,303

[22] Filed: Mar. 1, 1993

[30] Foreign Application Priority Data

Feb. 28, 1992 [JP] Japan ..... 4-043313
Feb. 28, 1992 [JP] Japan ..... 4-043315

[51] Int. Cl.[6] ..... H01P 1/203
[52] U.S. Cl. ..... 333/204; 333/246
[58] Field of Search ..... 333/202–205, 333/219, 246

[56] References Cited

U.S. PATENT DOCUMENTS 3,451,015 6/1969 Heath ..... 333/204
4,418,324 11/1983 Higgins ..... 333/204
4,692,726 9/1987 Green et al. ..... 333/206
4,963,843 10/1990 Peckham ..... 333/203
5,248,949 9/1993 Eguchi et al. ..... 333/204

FOREIGN PATENT DOCUMENTS 0258503 11/1986 Japan ..... 333/204
62-51803 3/1987 Japan .
64-78001 3/1989 Japan .

*Primary Examiner*—Seungsook Ham
*Attorney, Agent, or Firm*—Parkhurst, Wendel & Rossi

[57] ABSTRACT

A transmission line filter having an improved attenuation characteristic is disclosed. The transmission line filter includes at least input-side and output-side resonators disposed in a dielectric layer which are inductively coupled with each other. Additionally, intermediate resonators may be disposed between the input-side and output-side resonators. Further, input and output electrodes are provided in another dielectric layer, at least one of which is in an opposed facing relationship to a portion of the input-side resonator and a portion of the output-side resonator, so as to overlap only those portions of the input-side and output-side resonators. Where intermediate resonators are disposed, at least one of the input and output electrodes is disposed in an opposed facing relationship to one of the input-side and output-side resonators and a respective adjacent intermediate resonator so as overlap only the above-noted input-side resonator or output-side resonator and respective adjacent intermediate resonator.

34 Claims, 18 Drawing Sheets

LAYERED STRIPLINE FILTER

BACKGROUND OF THE INVENTION

1. Field of the Invention

The present invention relates to a transmission line filter, and more particularly relates to a transmission line filter employed in a high-frequency circuit filter for a high-frequency radio transceiver such as a portable telephone and to a transmission line filter employed in an antenna duplexer.

2. Description of the Related Art

In a conventional transmission line filter, both in a comb-line type filter and an interdigital-line type filter, resonators, each of which respectively has one end short-circuited to ground and respectively constitutes a $\frac{1}{4}$ wavelength stripline resonator, are disposed in parallel to obtain a desired frequency characteristic such as a bandwidth by distributed couplings induced between the adjacent resonators. In the conventional filter construction, however, the distributed couplings exist only between the adjacent resonators, and therefore the attenuation characteristic cannot be improved by forming an attenuation peak. To improve the attenuation characteristic, it is conceivable to increase the number of resonators. A problem, however, arises that the insertion loss increases with an increase in the number of the resonators.

Therefore, in addition to the couplings between the adjacent resonators, forming an additional coupling which jumps over the neighboring resonators has been proposed in order to form the attenuation peak in the frequency characteristic. As has been disclosed in Japanese Patent Application Laid-Open Publication No. 64-78001, for example, it has been proposed to couple resonators spaced away from one another so as to form the peak of attenuation on the high- or low-frequency side of a passband.

In this conventional transmission line filter however, coils for coupling the resonators, capacitive elements for coupling the spaced-away resonators, etc. are required in addition to the resonators. Therefore, not only fabrication of the transmission line filter requires much labor, but also the number of parts increases to cause a difficulty in size reduction.

SUMMARY OF THE INVENTION

It is, therefore, an object of the present invention to provide a transmission line filter wherein an attenuation characteristic is improved by forming an attenuation peak.

It is another object of the present invention to provide a transmission line filter which can be easily reduced in size.

According to one embodiment of the present invention, there is provided a transmission line filter, comprising:

a first ground electrode;

a dielectric layer disposed on the first ground electrode;

an input-side resonator disposed in the dielectric layer;

an output-side resonator disposed in the dielectric layer and inductively coupled with the input-side resonator; and at least one of an input electrode and an output electrode disposed in the dielectric layer and in an opposed facing relationship both to a portion of the input-side resonator and to a portion of the output-side resonator.

The transmission line filter may have both the input electrode and the output electrode. In such a case, preferably, the input-side resonator and the output-side resonator have a first main surface and a second main surface, respectively, the first main surface is in an opposed relationship to the second main surface, the input electrode is disposed in an opposed facing relationship both to a portion of the first main surface of the input-side resonator and to a portion of the first main surface of the output-side resonator, and the output electrode is disposed in an opposed facing relationship both to a portion of the second main surface of the input-side resonator and to a portion of the second main surface of the output-side resonator.

Preferably, the width of a portion of the input electrode which is in the opposed facing relationship to the portion of the output-side resonator is smaller than that of a portion of the input electrode which is in the opposed facing relationship to the portion of the input-side resonator, and the width of a portion of the output electrode which is in the opposed facing relationship to the portion of the input-side resonator is smaller than that of a portion of the output electrode which is in the opposed facing relationship to the portion of the output-side resonator.

The transmission line filter preferably further comprises a second ground electrode disposed on the dielectric layer.

According to another embodiment of the present invention, there is provided a transmission line filter, comprising:

a first ground electrode;

a dielectric layer disposed on the first ground electrode;

an input-side resonator disposed in the dielectric layer;

an output-side resonator disposed in the dielectric layer;

at least one intermediate resonator disposed between the input-side resonator and the output-side resonator and in the dielectric layer, the intermediate resonator nearest to the input-side resonator of the at least one intermediate resonator being inductively coupled with the input-side resonator, and the intermediate resonator nearest to the output-side resonator of the at least one intermediate resonator being inductively coupled with the output-side resonator; and at least one of an input electrode and an output electrode disposed in the dielectric layer, the input electrode being disposed in an opposed facing relationship both to a portion of the input-side resonator and to a portion of the intermediate resonator nearest to the input-side resonator, and the output electrode being disposed in an opposed facing relationship both to a portion of the output-side resonator and to a portion of the intermediate resonator nearest to the output-side resonator.

The transmission line filter may have both the input electrode and the output electrode. In such a case, preferably, the input-side resonator, the output-side resonator and the at least one intermediate resonator have a first main surface and a second main surface, respectively, the first main surface is in an opposed relationship to the second main surface, one of the first main surface and the second main surface is disposed in an opposed facing relationship to the first ground electrode, the input electrode is disposed in an opposed facing relationship both to a portion of the first main surface of the input-side resonator and to a portion of the first main surface of the intermediate resonator nearest to the input-side resonator, and the output electrode is disposed in an opposed facing relationship both to a portion of the second main surface of the output-side resonator and to a portion of the second main surface of the intermediate resonator nearest to the output-side resonator.

Preferably, the width of a portion of the input electrode which is in the opposed facing relationship to the portion of the intermediate resonator nearest to the input-side resonator is smaller than that of a portion of the input electrode which is in the opposed facing relationship to the portion of the input-side resonator, and the width of a portion of the output electrode which is in the opposed facing relationship to the portion of the intermediate resonator nearest to the output-side resonator is smaller than that of a portion of the output electrode which is in the opposed facing relationship to the portion of the output-side resonator.

The transmission line filter preferably further comprises a second ground electrode disposed on the dielectric layer.

In the one invention of the present application, because the transmission line filter includes a dielectric layer, an input-side resonator disposed in the dielectric layer, an output-side resonator disposed in the dielectric layer and inductively coupled with the input-side resonator and at least one of an input electrode and an output electrode disposed in the dielectric layer and in an opposed facing relationship both to a portion of the input-side resonator and to a portion of the output-side resonator, and because the transmission line filter includes a dielectric layer, an input-side resonator disposed in the dielectric layer, an output-side resonator disposed in the dielectric layer, at least one intermediate resonator disposed in the dielectric layer between the input-side resonator and the output-side resonator, the intermediate resonator nearest to the input-side resonator of the at least one intermediate resonator being inductively coupled with the input-side resonator, and the intermediate resonator nearest to the output-side resonator of the at least one intermediate resonator being inductively coupled with the output-side resonator, and at least one of an input electrode and an output electrode disposed in the dielectric layer, the input electrode being disposed in an opposed facing relationship both to a portion of the input-side resonator and to a portion of the intermediate resonator nearest to the input-side resonator, and the output electrode being disposed in an opposed facing relationship both to a portion of the output-side resonator and to a portion of the intermediate resonator nearest to the output-side resonator, an inductance is directly connected in series to at least either one of the input-side resonator and the output-side resonator to form an attenuation peak on the high-frequency side of the passband of a bandpass filter.

Furthermore, in this invention, inductances are respectively obtained by the inductive coupling between the input-side resonator and the output-side resonator, the inductive coupling between the input-side resonator and the intermediate resonator nearest to the input-side resonator, and the inductive coupling between the output-side resonator and the intermediate resonator nearest to the output-side resonator. Capacitances are respectively obtained by the capacitive coupling between each of the input-side and output-side resonators and at least one of the input electrode and the output electrode, the capacitive coupling between the input-side resonator and the intermediate resonator nearest to the input-side resonator, and the capacitive coupling between the output-side resonator and the intermediate resonator nearest to the output-side resonator. It is, therefore, unnecessary to provide specially external components used for the inductances and the capacitances. Thus, the transmission line filter can be reduced in size.

According to another invention of the present application, because the transmission line filter includes a dielectric layer, an input-side resonator disposed in the dielectric layer, an output-side resonator disposed in the dielectric layer, a coupling electrode disposed in the dielectric layer and in an opposed facing relationship both to a portion of the input-side resonator and to a portion of the output-side resonator, and one of an input electrode and an output electrode disposed in the dielectric layer and in an opposed facing relationship to a portion of the coupling electrode, and because the transmission line filter includes a dielectric layer, an input-side resonator disposed in the dielectric layer, an output-side resonator disposed in the dielectric layer, at least one intermediate resonator disposed in the dielectric layer between the input-side resonator and the output-side resonator, a first coupling electrode disposed in the dielectric layer and in an opposed facing relationship both to a portion of one of the input-side resonator and the output-side resonator and to a portion of the intermediate resonator nearest to the one of the input-side resonator and the output-side resonator, and one of an input electrode and an output electrode disposed in the dielectric layer in an opposed facing relationship to a portion of the coupling electrode, a capacitance is directly coupled in series with either one of the input-side resonator and the output-side resonator to form an attenuation peak on the low-frequency side of the passband of a bandpass filter.

Furthermore, by further providing a second coupling electrode disposed in the dielectric layer and in an opposed facing relationship both to a portion of the other of the input-side resonator and the output-side resonator and to a portion of the intermediate resonator nearest to the other of the input-side resonator and the output-side resonator, and the other of the input electrode and the output electrode disposed in the dielectric layer and in an opposed facing relationship to a portion of the second coupling electrode, capacitances are directly coupled in series with both of the input-side resonator and the output-side resonator, respectively, to form an attenuation peak on the low-frequency side of the passband of a bandpass filter.

Even in the case of the present invention, capacitances are respectively obtained by the capacitive coupling between each of the input-side and output-side resonators and the coupling electrode, the capacitive coupling between the coupling electrode and each of the input-side resonator and the intermediate resonator nearest to the input-side resonator, and the capacitive coupling between the coupling electrode and each of the output-side resonator and the intermediate resonator nearest to the output-side resonator. It is, therefore, unnecessary to provide specially external components used for the capacitances. Thus, the transmission line filter can be reduced in size.

BRIEF DESCRIPTION OF THE DRAWINGS

The above and further objects, features and advantages of the present invention will become more apparent from the following detailed description taken in conjunction with the accompanying drawings, wherein:

FIG. 27 is an alternative embodiment to that shown in FIG. 1.

DESCRIPTION OF THE PREFERRED EMBODIMENTS

First Embodiment

Figure 1:
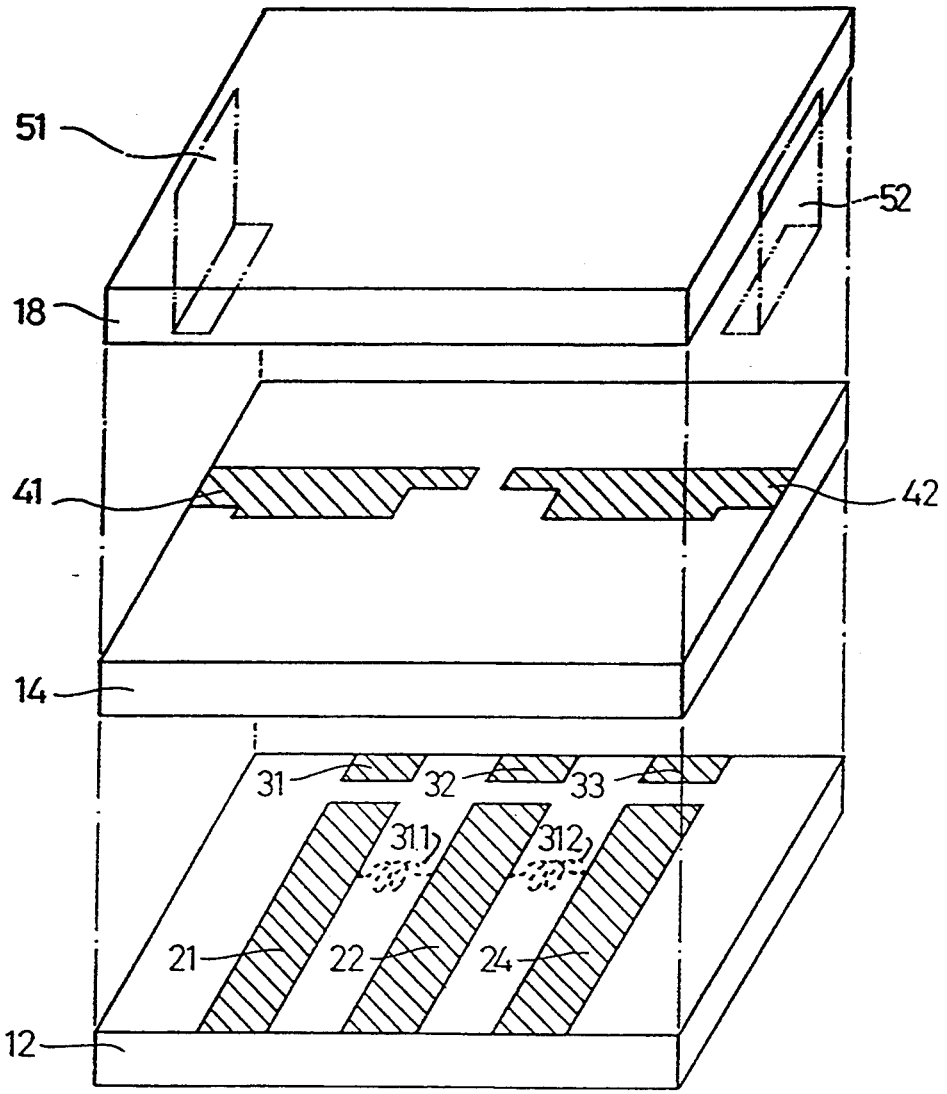
FIG. 1 is a schematic exploded perspective view showing a transmission line filter of a first embodiment of the present invention.
Figure 2:
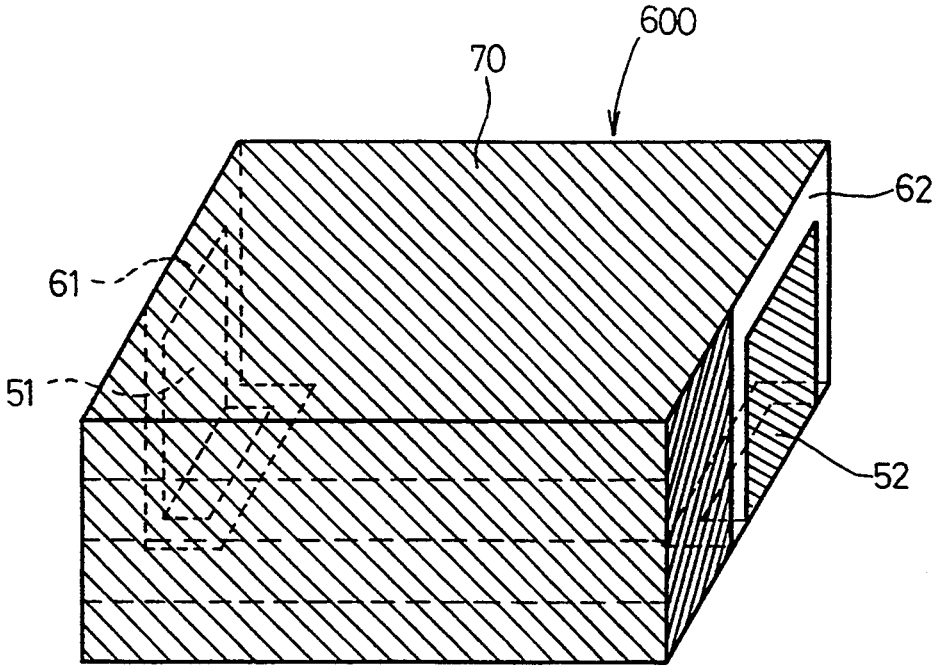
FIG. 2 is a perspective view showing the transmission line filter of the first embodiment of the present invention.
Figure 3:
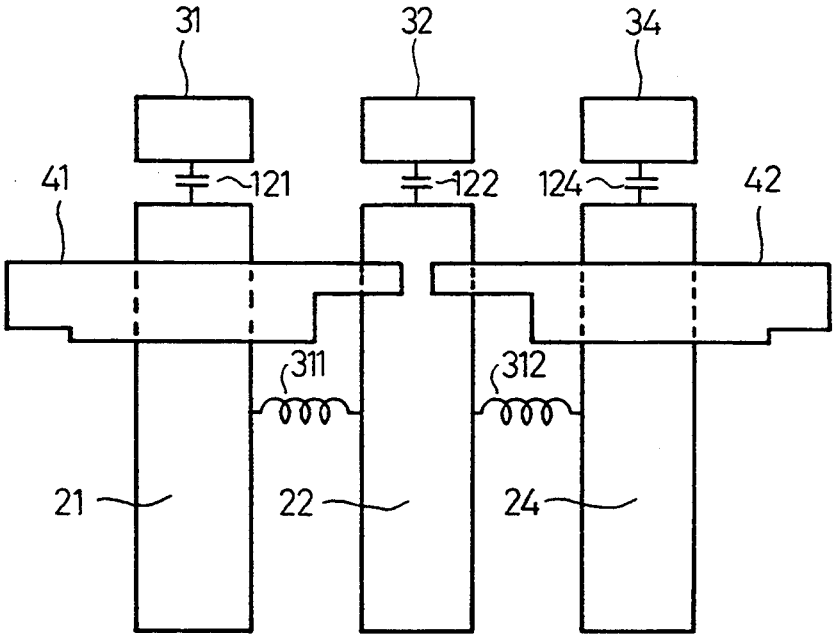
FIG. 3 is a schematic plan view showing the structure of a principal part of the transmission line filter of the first embodiment of the present invention.
Figure 4:
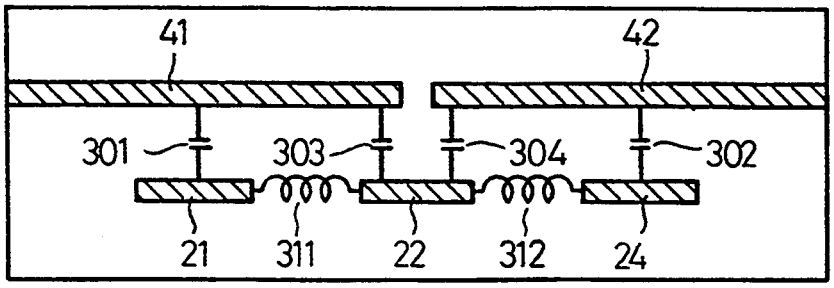
FIG. 4 is a cross-sectional view showing the structure of the principal part of the transmission line filter of the first embodiment of the present invention.

FIGS. 1 and 27 are schematic exploded perspective view showing a first embodiment of the present invention, FIG. 2 is a perspective view showing the first embodiment of the present invention, FIGS. 3 and 4 are respectively schematic plan and schematic side views showing the structure of a principal part of the first embodiment of the present invention according to FIG. 1.

Resonators 21, 22 and 24, which have one ends connected to a ground electrode 70 and constitute $\frac{1}{4}$ wavelength stripline resonators, are formed on a dielectric layer 12. Further, electrodes 31, 32 and 34, which have one ends each connected to the ground electrode 70 and the other ends respectively spaced at predetermined intervals away from the other ends of the resonators 21, 22 and 24 and opposed to the resonators 21, 22 and 24 respectively, are formed on the dielectric layer 12. A comb-line filter is constructed by making use of the inductive coupling between the respective adjacent resonators 21, 22 and 24. The resonator 21 is an input-side resonator, and the resonator 24 is an output-side resonator. Inductive couplings between the adjacent resonators are equivalently expressed by inductances 311 and 312, respectively. Incidentally, the ground electrode 70 is to be formed on the lower surface of the dielectric layer 12 later.

An input electrode 41 is formed on a dielectric layer 14 in such a way as to overlap the input-side resonator 21 and the resonator 22 adjacent to the resonator 21 with the dielectric layer 14 interposed therebetween and to meet at substantially right angles to the resonators 21 and 22. In FIG. 1, an output electrode 42 is also formed on the dielectric layer 14 in such a way as to overlap the output-side resonator 24 and the resonator 22 adjacent to the resonator 24 with the dielectric layer 14 interposed therebetween and to meet at substantially right angles to the resonators 22 and 24. In FIG. 27, an output electrode 42 is formed on dielectric layer 10.

Incidentally, the input electrode 41 is formed such that a portion thereof having a predetermined length, which includes a portion opposed to the resonator 22, has a smaller width, and the output electrode 42 is formed in such a way that a portion thereof having a predetermined length, which includes a portion opposed to the resonator 22, is made narrower in width.

A dielectric layer 18, an upper surface on which the ground electrode 70 is to be formed, is stacked on the dielectric layer 14. The dielectric layers 12, 14 and 18 are then combined into a single unit, followed by being fired, thereby producing a layered product 600. As shown in FIG. 2, the ground electrode 70 is formed on the upper and lower surfaces of the layered product 600 and the side surfaces thereof other than input and Output terminal portions 61 and 62.

Further, an input terminal 51, which is insulated from the ground electrode 70 and connected to the input electrode 41, is formed in the input terminal portion 61 formed on one side surface of the layered product 600. Furthermore, an output terminal 52, which is insulated from the ground electrode 70 and connected to the output electrode 42, is formed in the output terminal portion 62 formed on another side surface of the layered product 600.

FIGS. 3 and 4 are a plan view and a cross-sectional view, respectively, showing a spatial structure of the resonators 21, 22 and 24, the electrodes 31, 32 and 34, the input electrode 41 and the output electrode 42 all employed in the present embodiment and constructed as described above. There are regions where the respective resonators 21, 22 and 24 overlap their corresponding input and output electrodes 41 and 42 with the dielectric layer 14 interposed therebetween. Therefore, the respective resonators 21, 22 and 24 and their corresponding input and output electrode 41 and 42 are capacitively coupled at the overlapping regions with each other by respective capacitances 301, 302, 303 and 304. Further, capacitances 121, 122 and 123 are respectively induced between open-circuited end portions of the resonators 21, 22 and 23 and their corresponding electrodes 31, 32 and 33.

Figure 5:
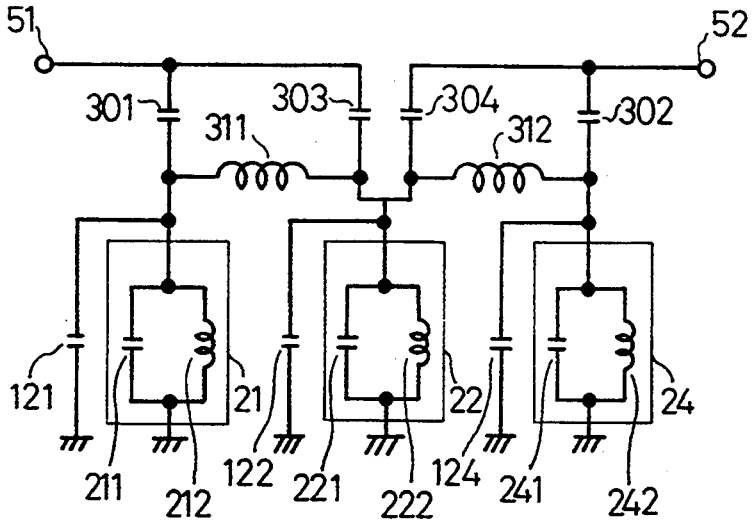
FIG. 5 is an equivalent circuit diagram of the transmission line filter of the first embodiment of the present invention.
Figure 6:
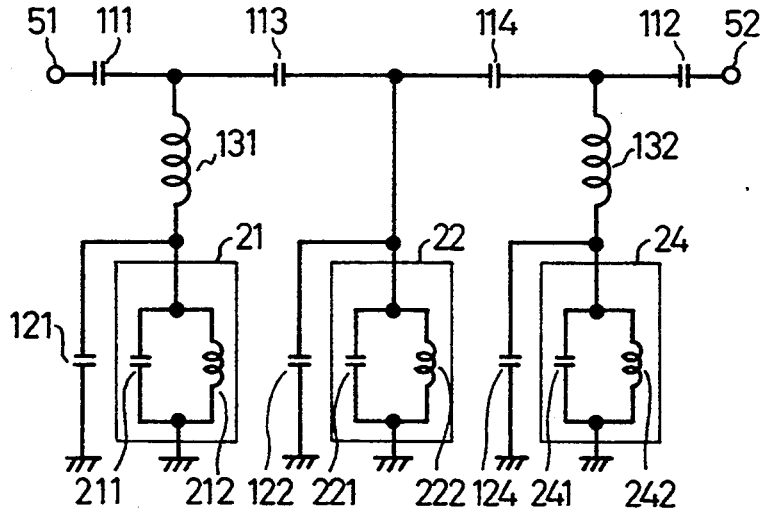
FIG. 6 is an equivalent circuit diagram of a wiring illustrated in FIG. 5.

An electrical equivalent circuit of the present embodiment constructed as described above is represented as shown in FIG. 5. The inductance 311, the capacitance 301 and the capacitance 303 shown in FIG. 5 are Δ-Y converted into an input-side capacitance 111, a coupling capacitance 113 and an inductance 131 connected in series to the resonator 21 all of which are shown in FIG. 6. Likewise, the inductance 312, the capacitance 302 and the capacitance 304 are Δ-Y converted into an output-side capacitance 112, a coupling capacitance 114 and an inductance 132 connected in series to the resonator 24. Thus, the equivalent circuit shown in FIG. 5 is converted into an equivalent circuit shown in FIG. 6, which exhibits a bandpass characteristic. Here, the capacitances 121, 122 and 124 and inductances 212, 222 and 242 of the respective parallel resonance circuits shown in FIGS. 5 and 6 respectively correspond to capacitances and inductances obtained by expressing the resonators 21, 22 and 24 with the lumped-constant equivalent circuit.

In the present embodiment, as described above, the inductance 131 and the inductance 132 are equivalently connected in series to the resonators 21 and 24, respectively. Thus, an attenuation peak appears on the high-frequency side of the passband of the bandpass filter according to the present embodiment.

The frequency at which the attenuation peak appears, varies depending upon the capacitances 303 and 304. The capacitance value of the capacitance 303 is set based on an area where the resonator 22 and the input electrode 41 are opposed to each other with the dielectric layer 14 interposed therebetween, provided that the dielectric layer 14 is constant in thickness, and the capacitance value of the capacitance 304 is set based on an area where the resonator 22 and the output electrode 42 are opposed to each other with the dielectric layer 14 interposed therebetween, provided that the thickness of the dielectric layer 14 is constant. Because the width of the resonator 22 and the widths of the input and output electrodes 41 and 42 can be relatively easily set up, the opposed facing area between the resonator 22 and the input electrode 41 and the opposed facing area between the resonator 22 and the output electrode 42 can be easily set without a dispersion. Accordingly, a dispersion in the frequency at which the attenuation peak appears, can be controlled by setting the opposed facing areas without a dispersion.

Figure 7:
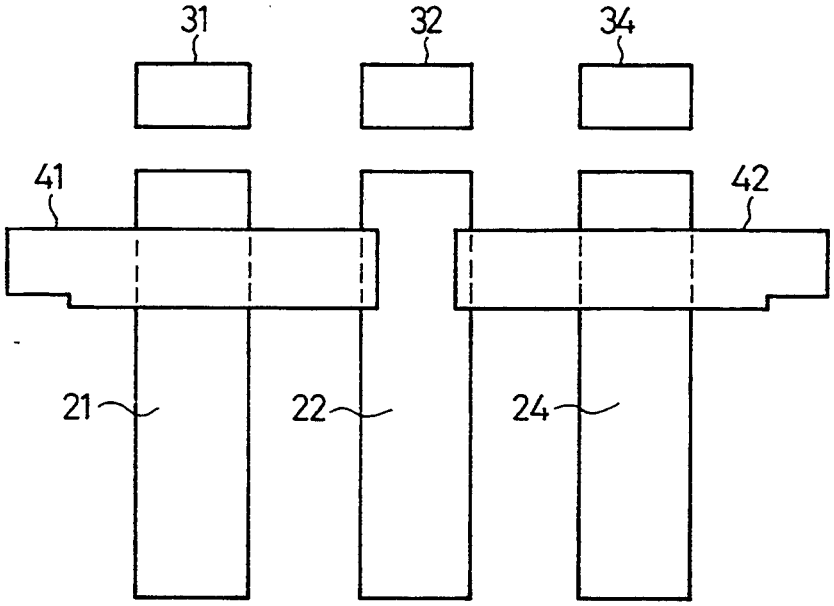
FIG. 7 is a plan view for explaining the relationship in position between resonators and input and output electrodes.

Furthermore, in the present embodiment, the input electrode 41 is set so as to become narrow in width over the predetermined length including the portion opposed to the resonator 22 as shown in FIGS. 1 and 3. Therefore, even if a displacement in position between the resonator 22 and the input electrode 41 takes place, a dispersion in the area where the resonator 22 and the input electrode 41 are opposed to each other, is hardly developed. As a result, a dispersion in the capacitance 303 becomes small. Further, the width of the output electrode 42 is also set to be narrow over the predetermined length including of the portion opposed to the resonator 22. Thus, even if a positional displacement occurs between the resonator 22 and the input electrode 41, a dispersion in the area where the resonator 22 and the output electrode 42 are opposed to each other, is hardly produced. As a result, a dispersion in the capacitance 304 becomes small. Therefore, a fluctuation in the frequency at which the attenuation peak appears, is further reduced as compared with both the case where the capacitance 303 having the same capacitance value is formed without decreasing the width of the input electrode 41 over the predetermined length including of the portion opposed to the resonator 22 and the case where the capacitance 304 having the same capacitance value is formed without decreasing the width of the output electrode 42 over the predetermined length including of the portion opposed to the resonator 22 (see FIG. 7).

Further, the inductances 311 and 312 are respectively obtained by inductive couplings between the resonators 21, 22 and 24. The capacitances 301, 302, 303 and 304 are also obtained by using the dielectric layer 14, the resonators 21, 22 and 24, the input electrode 41 and the output electrode 42. It is, therefore, unnecessary to provide specially external components, and the transmission line filter can be reduced in size.

Furthermore, in the above-described embodiment, the electrodes 31, 32 and 34 are formed on the dielectric layer 12. Therefore, the total capacitance of the respective parallel resonant circuits becomes equal to the sum of capacitances 211, 221 and 241 of the parallel resonant circuits of the resonators 21, 22 and 24 and the capacitances 121, 122 and 124 respectively formed between the resonators 21, 22 and 24 and their corresponding electrodes 31, 32 and 34. Assuming that the resonance frequencies of the respective parallel resonant circuits are not changed, then the inductances of the parallel resonance circuits become small. Thus, the length of each of the resonators 21, 22 and 24 becomes shorter, and therfore the entire length of the transmission line filter also becomes smaller.

A method of manufacturing the transmission line filter according to the first embodiment will next be explained.

The present transmission line filter is constructed in such a manner that the resonators 21, 22 and 24, the electrodes 31, 32 and 34, the input electrode 41 and the output electrode 42 are completely embeded in dielectrics. It is, therefore, desirable to use dielectric material of low loss and low resistivity for the resonators 21, 22 and 24, the electrodes 31, 32 and 34, the input electrode 41 and the output electrode 42, and it is preferable to use Ag-system or Cu-system conductors which have a low resistivity.

A ceramic dielectric is preferably used for the dielectric material to be used in the transmission line filter because the ceramic dielectric has high reliability and has a large dielectric constant $\epsilon_\gamma$, which can reduce the size of the transmission line filter.

Preferred as the manufacturing method is one wherein conductive pastes are applied on green sheets containing ceramic powder so as to form electrode patterns thereon and the thus processed respective green sheets are thereafter stacked and then fired, and conductors are formed integrally with the ceramic dielectrics in the form of a structure in which the conductors are embeded in the ceramic dielectrics.

When the Ag or Cu conductors are used, it is difficult to co-fire the conductors with normally-used dielectric materials, because the conductors have a low melting point. It is, therefore, necessary to use dielectric materials which can be fired at a temperature lower than the melting point (1110° C. or lower) of the conductors. Further, the dielectric materials are preferably required to have a temperature characteristic (temperature coefficient) of the resonance frequency of a parallel resonance circuit which is ±50 ppm/°C. or less, in view of the nature of a device which serves as a microwave filter. Examples of such dielectric materials may include glass materials such as a mixture of cordierite glass powder, $TiO_2$ powder and $Nd_2Ti_2O_7$ powder, etc., and materials obtained by adding a slight glass-forming component or a glass powder to a $BaO$-$TiO_2$—$RE_2O_3$—$Bi_2O_3$ composition (RE: rare earth components), and materials obtained by adding a slight glass powder to a dielectric ceramic power of barium oxide-titanium oxideneodymium oxide.

One example of a dielectric materials will be described. 73 wt % of glass powder composed of 18 wt % of MgO, 37 wt % of $Al_2O_3$, 37 wt % of $SiO_2$, 5 wt % of $B_2O_3$ and 3 wt % of $TiO_2$, 17 wt % of commercially available $TiO_2$ powder, and 10 wt % of $Nd_2Ti_2O_7$ powder were thoroughly mixed to obtain mixed powder. Incidentally, as the $Nd_2Ti_2O_7$ powder, one obtained by calcining $Nd_2O_3$ powder and $TiO_2$ powder at 1200° C. and thereafter grinding the resultant product was used. Then, an acrylic organic binder, a plasticizer, toluene and an alcoholic solvent were added to the mixed powder, and these materials were thoroughly mixed with alumina cobblestone to obtain a slurry. A green sheet having a thickness of 0.2 mm to 0.5 mm was fabricated using the slurry by the doctor blade method.

In the first embodiment referred to above, the conductor patterns shown in FIG. 1 were respectively printed on the green sheet by using a silver paste as a conductor paste. In order to adjust the thickness of the green sheets on which the conductor patterns were printed, necessary green sheets were thereafter stacked so as to form a structure shown in FIG. 1. The resultant product was fired at 900° C. to produce the layered product 600.

The ground electrode 70 composed of silver electrode, was printed on the upper and lower surfaces of the layered product 600 and the side surfaces thereof other than the input and output terminal portions 61 and 62 as shown in FIG. 2. Further, silver electrodes electrically insulated from the ground electrode 70 and respectively connected to the input electrode 41 and the output electrode 42, were printed in the input and output terminal portions 61 and 62 as the input and output terminals 51 and 52, respectively. The printed silver electrodes were fired at 850° C.

When, in the transmission line filter, the width of each of the resonators 21, 22 and 24 was set to be 0.8 mm, each of intervals between the respective adjacent resonators was set to be 1.2 mm, the length of each of the resonators 21, 22 and 24 was set to be 4 mm, the width of each of the electrodes 31, 32 and 34 was set to be 0.8 mm, the length of each of the electrodes 41, 42 and 44 was set to be 0.5 mm, an interval between each of the resonators 21, 22 and 24 and each of the electrodes 31, 32 and 34 respectively opposed to the resonators 21, 22 and 24 was set to be 0.3 mm, an area where the input electrode 41 and the resonator 22 are opposed to each other was set to be 0.96 $mm^2$ an area where the output electrode 42 and the resonator 22 are opposed to each other was set to be 0.96 $mm^2$ and the thickness of each of the dielectric layers 12, 14 and 18 was set to be 0.2 mm, the center frequency of the transmission line filter was 1800 MHz, its bandwidth was 75 MHz, and its insertion loss was 2.2 dB or less. Further, the frequency at which the attenuation peaks appears was 1960 MHz and the attenuation at that frequency was 50 dB. When thirty transmission line filters were fabricated under this condition, a dispersion in the frequency at which the attenuation peak appears, was 4 MHz in the standard deviation.

When the input electrode 41 was fabricated in such a manner that the width of the portion thereof opposed to the resonator 22 was not made smaller and the area where the input electrode 41 and the resonator 22 were opposed to each other was made equal to that of the above embodiment, and the output electrode 42 was fabricated in such a manner that the width of the portion thereof opposed to the resonator 22 was not made smaller and the area where the output electrode 42 and the resonator 22 were opposed to each other was made identical to the above embodiment, (see FIG. 7), the center frequency was 1800 MHz, the bandwidth was 75 MHz, the insertion loss was 2.3 dB or less. The frequency at which the attenuation peak appears was 1950 MHz and the attenuation at that frequency was 50 dB. When thirty transmission line filters were produced under this condition, a dispersion in the frequency at which the attenuation peak appears was 10 MHz in the standard deviation.

The above-described embodiment show, as an illustrative example, the case where the three resonators are used. However, two resonators may be used as an alternative. In this case, the resonator 22 and the electrode 32 are removed from the aforementioned embodiment, the resonator 21 is formed to be inductively coupled with the resonator 24, the input electrode 41 is formed to be in an opposed facing relationship to a portion of the resonator 21 and to a portion of the resonator 24, the output electrode 42 is formed to be in an opposed facing relationship to a portion of the resonator 21 and to a portion of the resonator 24, and the resonators 21 and 24 are disposed between the input electrode 41 and the output electrode 42.

Figure 10:
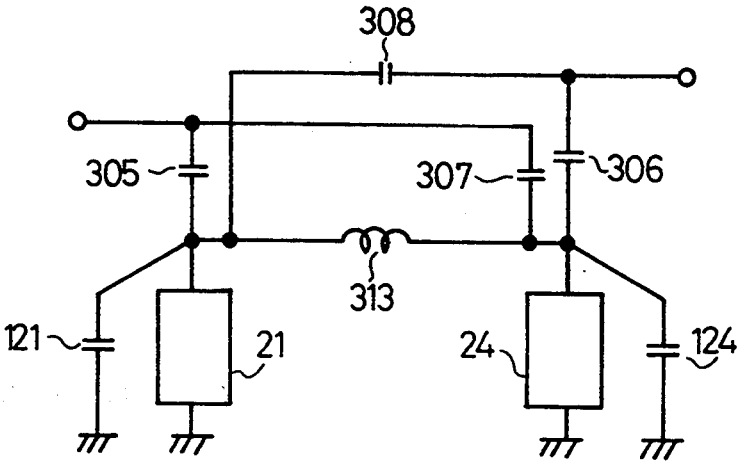
FIG. 10 is an equivalent circuit diagram of the transmission line filter wherein the number of the resonators is reduced in the first embodiment of the present invention.

An electrical equivalent circuit of the modified embodiment referred to above is represented as shown in FIG. 10. In this case, the operation of the modified embodiment is similar to that of the aforementioned embodiment. Here, capacitances 305 and 307 respectively represent capacitances which are respectively induced between the resonator 21 and the input electrode 41 and between the resonator 24 and the input electrode 41. Capacitances 306 and 308 respectively represent capacitances which are respectively induced between the resonator 24 and the output electrode 42 and between the resonator 21 and the output electrode 42. Further, an inductance 313 represents an inductance of the inductive coupling between the resonators 21 and 24.

Figure 11:
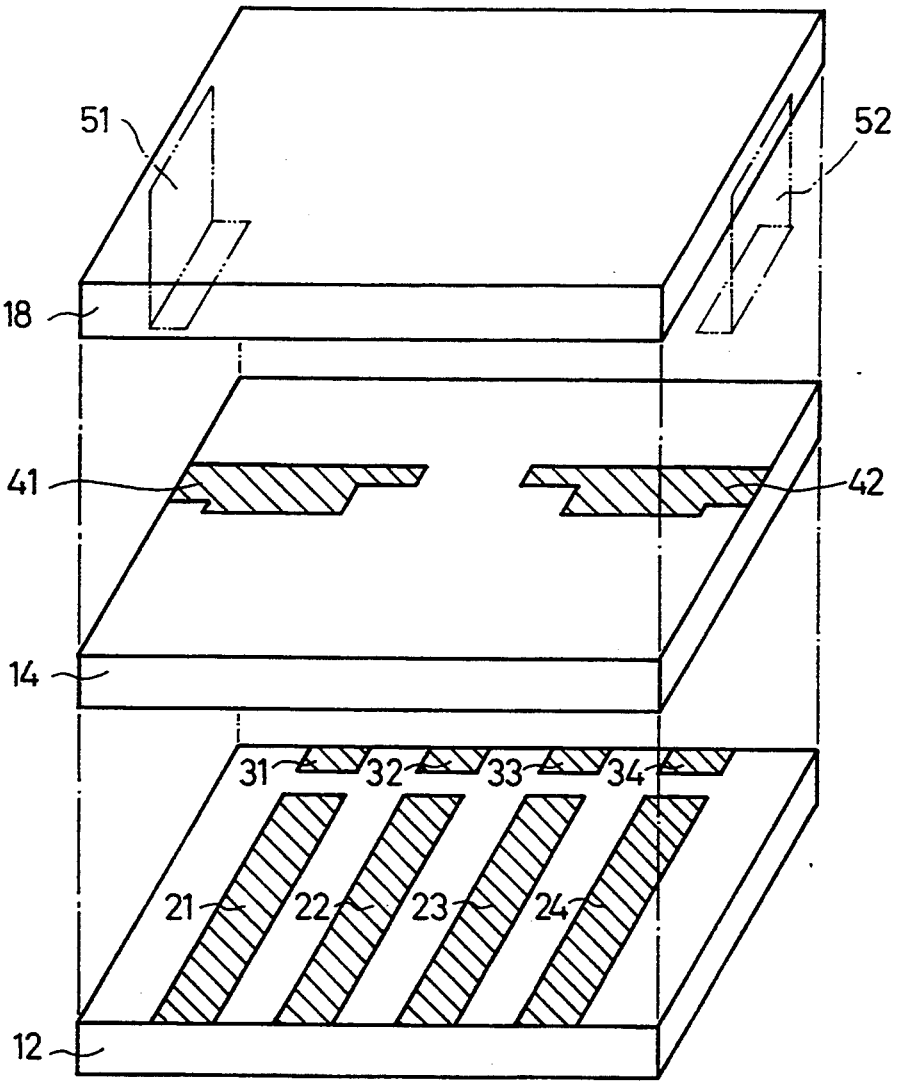
FIG. 11 is a schematic exploded perspective view showing a transmission line filter wherein the number of the resonators is increased in the first embodiment the present invention.
Figure 12:
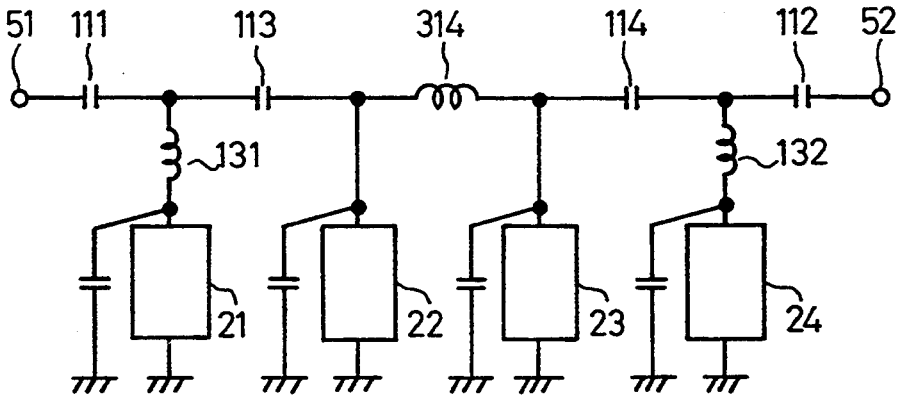
FIG. 12 is an equivalent circuit diagram of the transmission line filter wherein the number of the resonators is increased in the first embodiment of the present invention.

Further, the number of the resonators may exceed three. When a resonator 23 is disposed between the resonators 22 and 24 as shown in FIG. 11 by way of illustrative example and the resonator 22 is made to be inductively coupled with the resonator 23, an electrical equivalent circuit is represented as shown in FIG. 12, and the resonator 22 and the resonator 23 are electrically connected to each other by an inductance 314. Even in this case, the operation of the circuit is effected in the same manner as the above-described embodiment.

Figure 8:
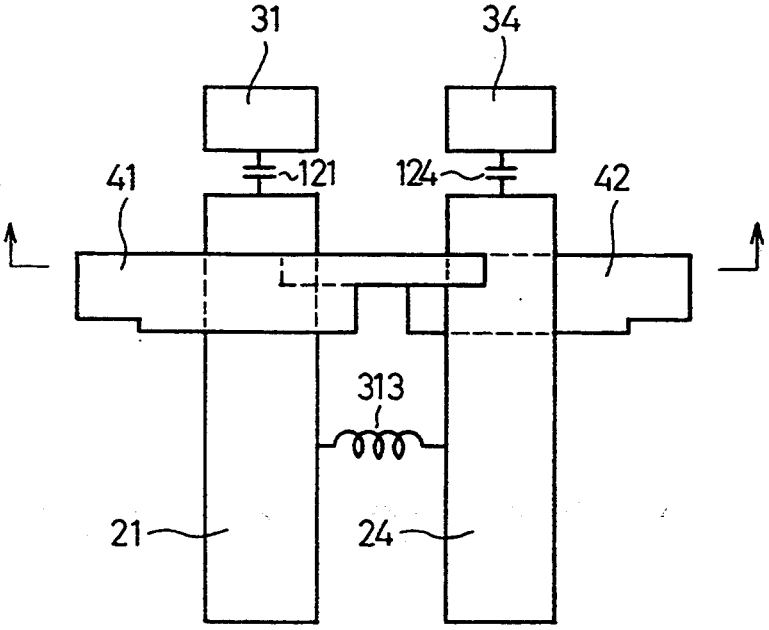
FIG. 8 is a schematic plan view showing the structure of a principal part of the transmission line filter wherein the number of the resonators is reduced in the first embodiment of the present invention.
Figure 9:
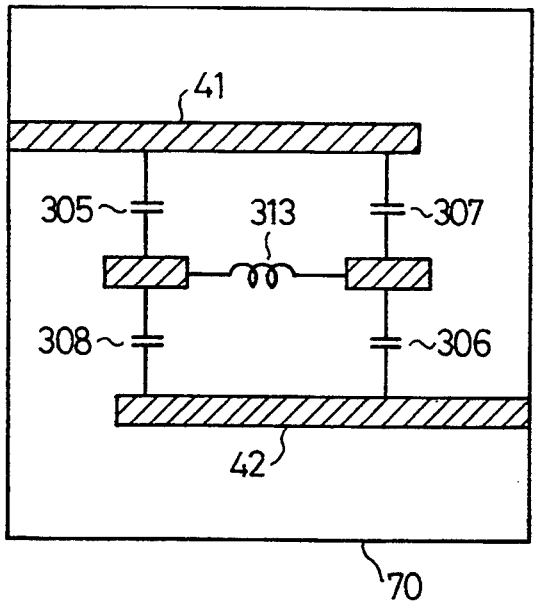
FIG. 9 is a cross-sectional view showing the structure of the principal part of the transmission line filter wherein the number of the resonators is reduced in the first embodiment of the present invention.

Even in the case where the number of the resonators exceeds three, resonance electrodes may be formed between the input electrode 41 and the output electrode 42 in the same manner as in the case where the two resonators are provided as shown in FIG. 8.

When the resonator 22 is made to be capacitively coupled with the resonator 23, an electrical equivalent circuit is represented by connecting the resonators 22 and 23 to each other using a capacitance as an alternative to the inductance 314 shown in FIG. 12. Even in this case, however, the operation of the circuit is effected in the same manner as the above embodiment. In this case, the coupling between the resonators 21 and 22, and the coupling between the resonators 23 and 24 should be inductive, but the resonators 22 and 23 may be either inductively or capacitively coupled with each other.

The first embodiment shows the case where the arrangement of the resonators is of a comb-line type. However, the resonators may also be of an interdigital-line type.

Second Embodiment

Figure 13:
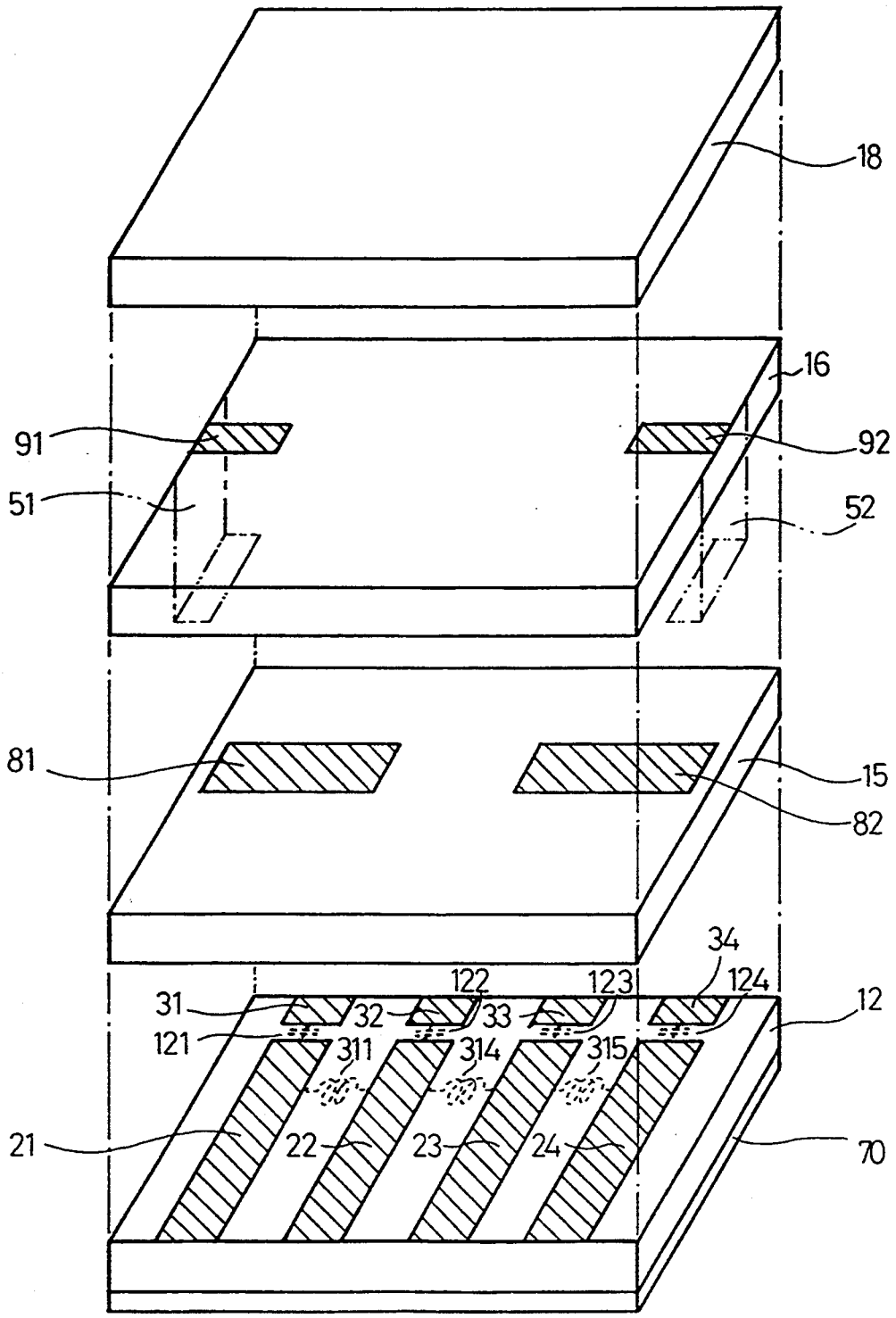
FIG. 13 is a schematic exploded perspective view showing a transmission line filter of a second embodiment of the present invention.
Figure 14:
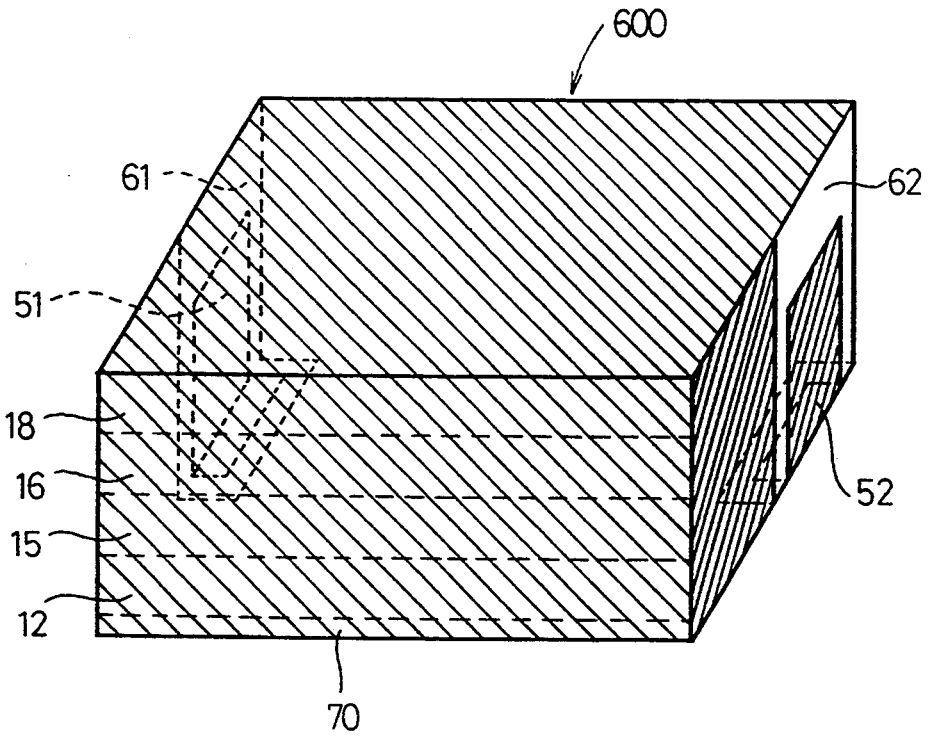
FIG. 14 is a perspective view showing the transmission line filter of the second embodiment of the present invention.
Figure 15:
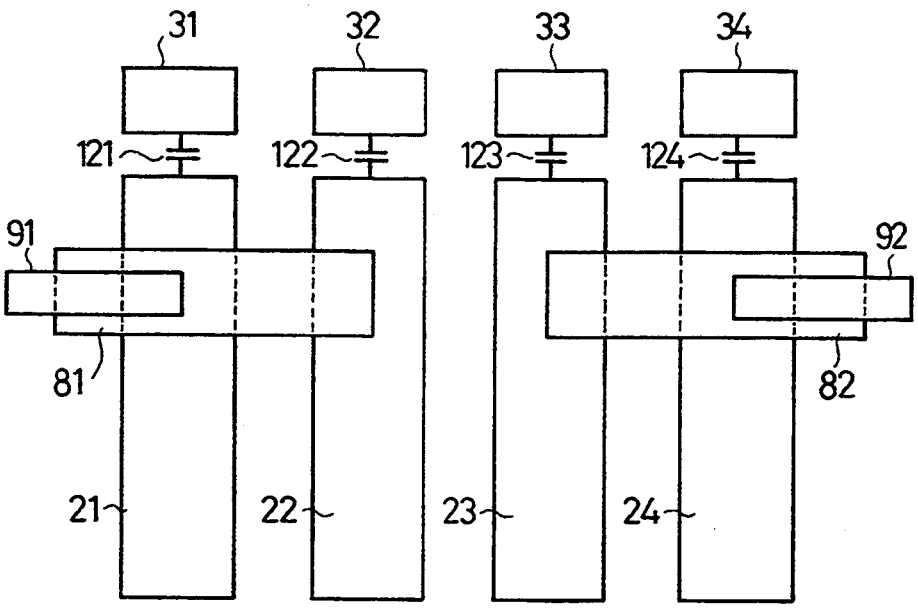
FIG. 15 is a schematic plan view showing the structure of a principal part of the transmission line filter of the second embodiment of the present invention.
Figure 16:
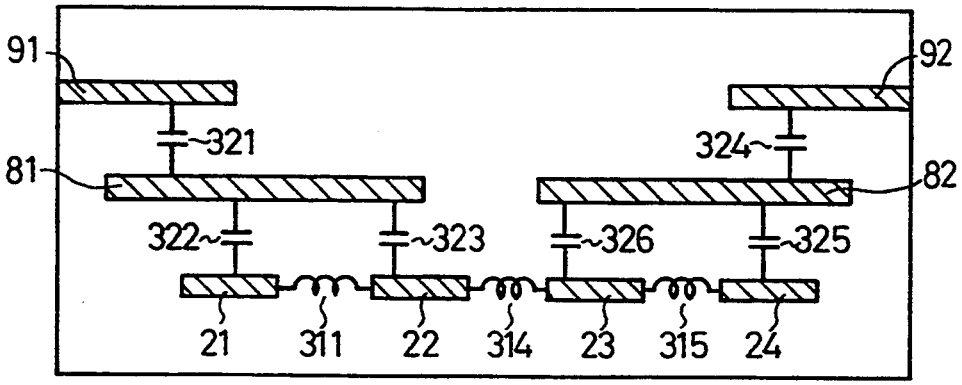
FIG. 16 is a cross-sectional view showing the structure of the principal part of the transmission line filter of the second embodiment of the present invention.

FIG. 13 is a schematic exploded perspective view showing the second embodiment of the present invention, FIG. 14 is a perspective view of the second embodiment of the present invention, FIGS. 15 and 16 are respectively a schematic plan view and a schematic side view showing the structure of a principal part of the second embodiment of the present invention.

Resonators 21 through 24, which have one ends connected to a ground electrode 70 and constitute $\frac{1}{4}$ wavelength stripline resonators, are formed on a dielectric layer 12. Further, electrodes 31 through 34, which have one ends connected to the ground electrode 70 and the other ends respectively spaced at predetermined intervals away from the other ends of the resonators 21 through 24 and opposed to the resonators 21 through 24 respectively, are formed on the dielectric layer 12. A comb-line filter is constructed by making use of the inductive coupling between the respective adjacent resonators 21 through 24. Here, capacitances 121 through 124 are respectively added between respective open-circuited end portions of the resonators 21 through 24 and the ground due to the existence of the electrodes 31 through 34. Therefore, each of the resonators 21 through 24 resonates at a frequency of less than $\frac{1}{4}$ wavelength. The adjacent resonators are electromagnetically coupled with one another. The electromagnetic coupling between the adjacent resonators is represented by each of inductances 311, 314 and 315 if equivalently represented by a lumped constant. The resonator 21 is an input-side resonator, and the resonator 24 is an output-side resonator. Incidentally, the ground electrode 70 is to be formed on the lower surface of the dielectric layer 12 later.

A coupling electrode 81 is formed on a dielectric layer 15 in such a way as to overlap the input-side resonator 21 and the resonator 22 adjacent to the resonator 21 with the dielectric layer 15 interposed therebetween and to meet at substantially right angles to the resonators 21 and 22. A coupling electrode 82 is also formed on the dielectric layer 15 in such a way as to overlap the output-side resonator 24 and the resonator 23 adjacent to the resonator 24 with the dielectric layer 15 interposed therebetween and to meet at substantially right angles to the resonators 23 and 24.

An input electrode 91 is formed on a dielectric layer 16 so as to overlap the coupling electrode 81 with the dielectric layer 16 interposed therebetween, and an output electrode 92 is formed on the dielectric layer 16 so as to overlap the coupling electrode 82 with the dielectric layer 16 interposed therebetween.

A dielectric layer 18, an upper surface on which the ground electrode 70 is to be formed, is stacked on the dielectric layer 16. The dielectric layers 12, 15, 16 and 18 are then combined into a single unit, followed by being fired, thereby forming a layered product 600.

As shown in FIG. 14, the ground electrode 70 is formed on the upper and lower surfaces of the layered product 600 and the side surface thereof other than input and output terminal portions 61 and 62.

Further, an input terminal 51, which is insulated from the ground electrode 70 and connected to the input electrode 91, is formed in the input terminal portion 61 formed on one side surface of the layered product 600. Furthermore, an output terminal 52, which is insulated from the ground electrode 70 and connected to the output electrode 92, is formed in the output terminal portion 62 formed on another side surface of the layered product 600.

FIGS. 15 and 16 are a plan view and a cross-sectional view, respectively, showing a spatial structure of the resonators 21 through 24, the coupling electrodes 81 and 82, the input electrode 91 and the output electrode 92 all employed in the present embodiment and constructed as described above. Among the respective resonators 21 through 24, the coupling electrodes 81 and 82 and the input and output electrodes 41 and 42, there are the portions which overlap each other. The dielectric layers respectively exist between the respective portions which overlap each other. Therefore, the mutually-overlapping portions with the dielectric layers interposed therebetween are capacitively coupled with one another. These input-side capacitances are respectively represented as capacitances 321, 322 and 323. Further, output-side capacitances, which are respectively induced between the portions at which the coupling electrode 82 and the output electrode 92 overlap each other and between the portions at which the resonators 23, 24 and the coupling electrode 82 overlap each other, are respectively represented as capacitances 324, 325 and 326.

Figure 17:
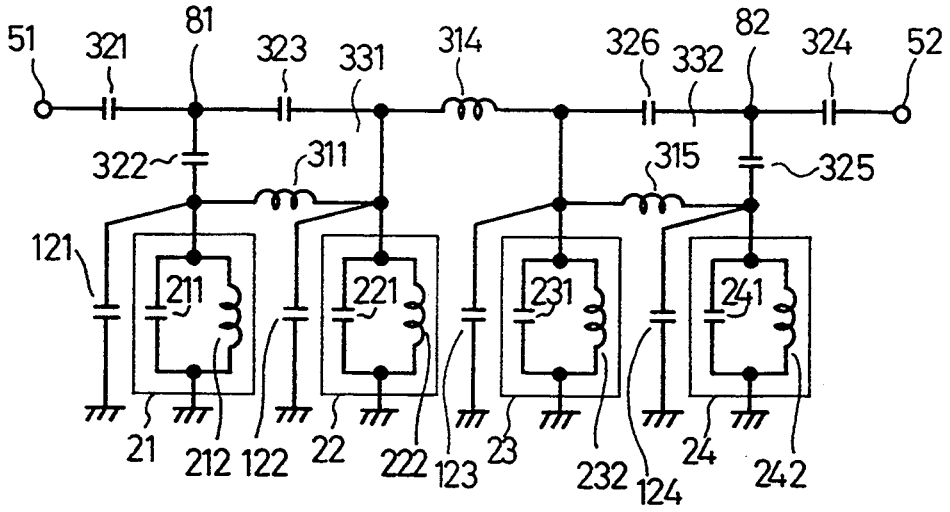
FIG. 17 is an equivalent circuit diagram of the transmission line filter of the second embodiment of the present invention.
Figure 18:
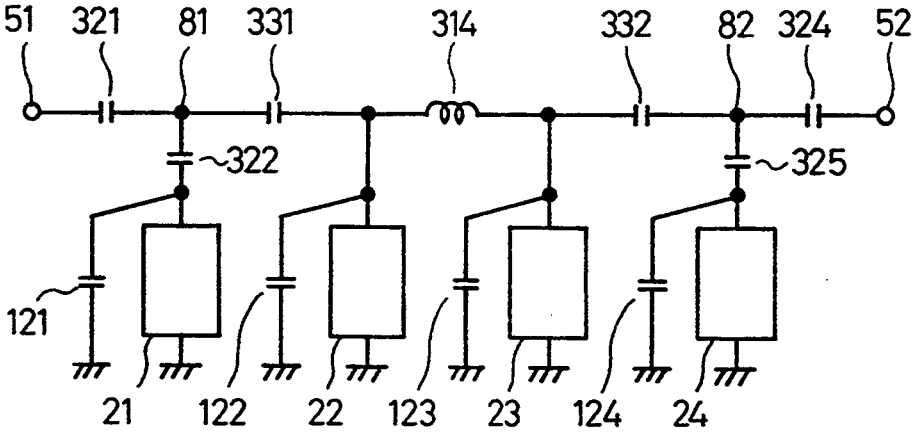
FIG. 18 is an equivalent circuit diagram of a wiring illustrated in FIG. 17.

An electrical equivalent circuit of the transmission line filter according to the present embodiment is shown in FIG. 17. Here, capacitances 211, 221, 231 and 241 and inductances 212, 222, 232 and 242 of respective parallel resonance circuits shown in FIG. 17 are capacitances and inductances obtained by equivalently converting the resonators 21 through 24 with lumped-constants, respectively. In the construction of the present embodiment, the capacitances 322 and 323 are large, and therefore the inductance 311 is negligible. Thus, the coupling between the resonators 21 and 22 is made to be capacitive. The capacitance, which exists between the resonators 21 and 22, is represented as a capacitance 331 in FIG. 18. Likewise, the capacitances 325 and 326 are large, and therefore the inductance 315 is negligible. Thus, the coupling between the resonators 23 and 24 becomes capacitive. The capacitance, which exists between the resonators 23 and 24, is represented as a capacitance 332 as illustrated in FIG. 18.

In the present embodiment as described above, the capacitance 322 is equivalently connected in series to the resonator 21 and the capacitance 325 is equivalently connected in series to the resonator 24. Therefore, an attenuation peak appears on the low-frequency side of the passband of the bandpass filter.

The frequency at which the attenuation peak appears on the low-frequency side, varies according to the values of the capacitances 322 and 325 respectively connected in series to the resonators 21 and 24.

Figure 19A:
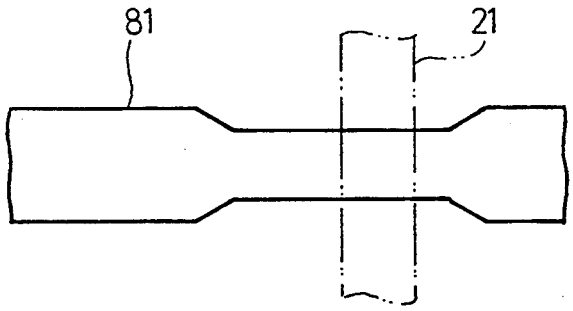
FIGS. 19A and 19B are plan views for explaining the relationship in position between a resonator and a coupling electrode employed in the transmission line filter of the second embodiment of the present invention.
Figure 19B:
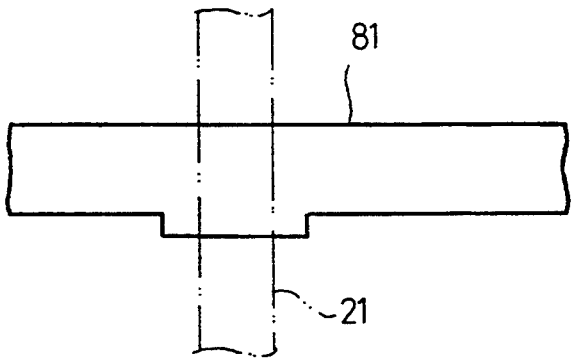

When, however, the thickness of the dielectric layer 15 is fixed, then the capacitance 322 connected in series to the resonator 21 can be arbitrarily set by setting the area of the portion of the coupling electrode 81 which portion is in the opposed facing relationship to the resonator 21 with the dielectric layer 15 interposed therebetween. Since the widths of the resonator 21 and the coupling electrode 81 can be easily set, the area where the resonator 21 and the coupling electrode 81 are opposed to each other, can also be easily set up without a dispersion. Therfore, a dispersion in the frequency at which the attenuation peak appears, can be controlled by invariably setting up the opposed area without a dispersion. Furthermore, by setting the width of the coupling electrode 81 over a wide range as compared with the width of the resonator 21 as shown in FIGS. 19A and 19B, the area where the resonator 21 and the coupling electrode 81 are opposed to each other dose not change, even if the relative position between the resonator 21 and the coupling electrode 81 varies. Therefore the capacitance 322 between the resonator 21 and the coupling electrode 81 remains unchanged, thereby making it possible to effect further control of a dispersion in the frequency at which the attenuation peak appears. The mutual relationship between the resonator 24 and the coupling electrode 82 is also identical to that between the resonator 21 and the coupling electrode 81.

The capacitance 321 is obtained by the capacitive coupling between the input electrode 91 and the coupling electrode 81. The capacitances 322 and 323 are respectively obtained by the capacitive coupling between the resonator 21 and the coupling electrode 81 and the capacitive coupling between the resonator 22 and the coupling electrode 81, the capacitance 324 is obtained by the capacitive coupling between the output electrode 92 and the coupling electrode 82, and the capacitances 325 and 326 are respectively obtained by the capacitive coupling between the resonator 23 and the coupling electrode 82 and that between the resonator 24 and the coupling electrode 82. It is, therefore, unnecessary to provide additional external components and hence the transmission line filter can be reduced in size.

Furthermore, in the present embodiment, because the electrodes 31 through 34 are formed on the dielectric layer 12, the total capacitance of the respective parallel resonance circuits shown in FIGS. 17 and 18 is equal to the respective sum of the capacitances 211, 221, 231 and 241 obtained by equivalently converting the resonators 21 through 24 with the lumped constants and the capacitances 121 through 124 respectively formed between the resonators 21 through 24 and their corresponding electrodes 31 through 34. Assuming that the resonance frequencies of the resonators 21 through 24 are not changed, then the inductances of the parallel resonance circuits become small. Thus, the length of each of the resonators 21 through 24 becomes short, and therefore the transmission line filter can be reduced in volume.

Next, a method of manufacturing the transmission line filter according to the present embodiment will be explained below. In the case of the present embodiment, the conductor patterns shown in FIG. 13 were first respectively printed on the green sheets employed in the first embodiment by using a silver paste as a conductor paste. In order to adjust the thickness of the green sheets on which the conductor patterns have been printed, necessary green sheets were then stacked so as to form the structure shown in FIG. 13. Thereafter, the resultant product was fired at 900° C. to produce a layered product 600.

The ground electrode 70 composed of silver electrode, is printed on the upper and lower surfaces of the layered product 600 and the side surfaces thereof other than the input terminal portion 61 and the output terminal portion 62, as shown in FIG. 14. Further, silver electrodes electrically insulated from the ground electrode 70 and respectively connected to the input electrode 91 and the output electrode 92, are printed in the input and output terminal portions 61 and 62 as the input and output terminals 51 and 54, respectively. The printed silver electrodes were fired at 850° C.

When, in the aforementioned transmission line filter, the width of each of the resonators 21, 22, 23 and 24 was set to be 0.8 mm, each of intervals between the respective adjacent resonators was set to be 1.2 mm, the length of each of the resonators 21, 22, 23 and 24 was set to be 4 mm, the width of each of the electrodes 31, 32, 33 and 34 was set to be 0.8 mm, the length of each of the electrodes 31, 32, 33 and 34 was set to be 0.5 mm, the interval between each of the resonators 21, 22, 23 and 24 and each of the electrodes 31, 32, 33 and 34 respectively opposed to the resonators 21, 22, 23 and 24 was set to be 0.3 mm, each of areas where the coupling electrodes 81 and 82 and the resonators 21 and 24 are respectively opposed to each other was set to be 0.64 $mm^2$, and the thickness of each of the dielectric layers 12, 15, 16 and 18 was set to be 0.2 mm, the center frequency of the transmission line filter was 1800 MHz, its bandwidth was 75 MHz, and its insertion loss thereof was 2.4 dB or less. Further, the frequency at which the attenuation peak appears was 1705 MHz and the attenuation at that frequency was 45 dB.

Further, when the width of each of the portions of the coupling electrodes 81 and 82, which overlap the resonators 21 and 24 respectively, was set to a width spread out 0.2 mm by 0.2 mm toward both sides of the coupling electrodes 81 and 82, i.e., the width was broadened by 0.4 mm along the longitudinal direction of each resonator so that each portion has a width of 1.2 mm in total (each of areas where the coupling electrodes 81 and 82 and the resonators 21 and 24 are respectively opposed to each other, was set to be 0.92 $mm^2$), the center frequency was 1800 MHz, the bandwidth was 75 MHz, and the insertion loss was 2.3 dB or less. Further, the frequency at which the attenuation peak appears was 1655 MHz and the attenuation at that frequency was 50 dB.

The above-described embodiment shows, as an illustrative example, the case where the coupling between the adjacent resonators 21 through 24 is made as the inductive coupling. However, the resonators 21 and 22, 22 and 23, and 23 and 24 may be respectively capacitively coupled with each other.

The above-described embodiment shows the case where the arrangement of the resonators is of a combline type. However, the resonators may be of an interdigital-line type.

Incidentally, the following means has been used to form the attenuation peak in a conventional transmission line filter. Described specifically, as shown in FIG. 20A by way of illustrative example (see Japanese Patent Application Laid-Open Publication No. 62-51803), a plurality of resonators 531 through 535 are connected to a guard electrode 502 formed on an end portion of one surface of a dielectric substrate 501. A ground electrode (now shown) is formed on the other surface, i.e., the entire reverse side of the dielectric substrate 501. Further, the resonators 531 through 535 are capacitively coupled with each other through the dielectric substrate 501 by capacitances 541 through 544 which respectively exist between the resonators 531 and 532, between the resonators 532 and 534 and between the resonators 534 and 535. Thus, a comb-line filter is formed under the above configuration. An electrode 561, which is electrically coupled with the resonators 531 and 532 by capacitances 551 and 552, is formed as an input terminal between the resonator 531 and the resonator 532 adjacent to the resonator 531. Likewise, an electrode 562, which is electrically coupled with the resonators 535 and 534 by capacitances 553 and 554, is formed as an output terminal between the resonator 535 and the resonator 534 adjacent to the resonator 535.

Figure 20B:
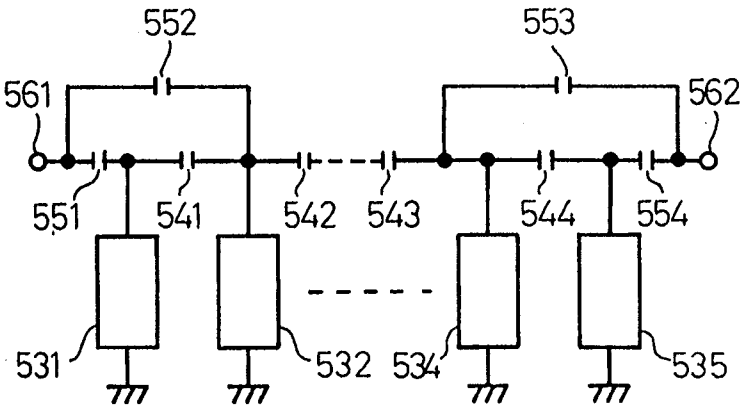
FIGS. 20B through 20D are respectively equivalent circuit diagrams showing the transmission line filter illustrated in FIG. 20A.
Figure 20D:
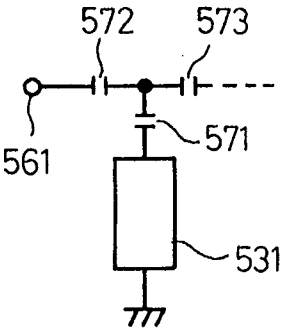
Figure 20A:
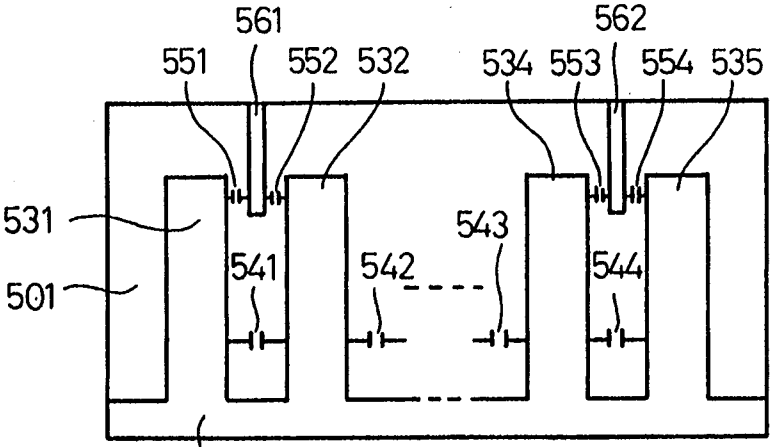
FIG. 20A is a plan view showing the structure of a conventional transmission line filter.
Figure 20C:
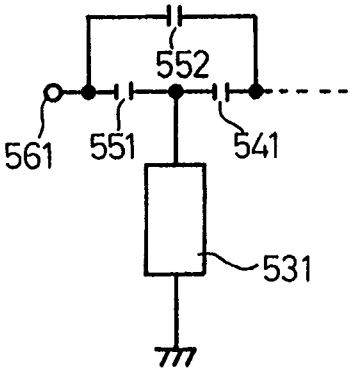
Figure 21:
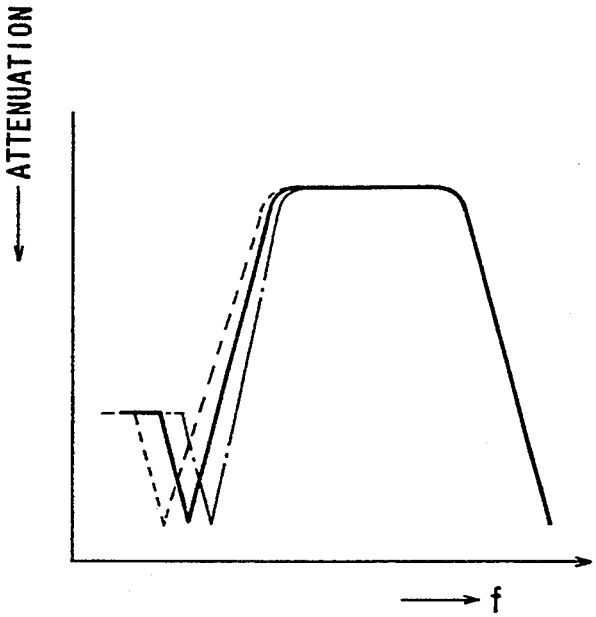
FIG. 21 is a graph showing a frequency characteristic of a transmission line filter.

An electrical equivalent circuit of the conventional transmission line filter is represented as shown in FIG. 20B. If the transmission line filter is seen from the input side, then its equivalent circuit is represented as illustrated in FIG. 20C. The capacitances 541, 551 and 552 are converted into capacitances 571, 572 and 573 by Δ-Y conversion as illustrated in FIG. 20D. In this case, it has been known that the frequency at which the attenuation peak of a bandpass filter appears, varies due to the existence of the capacitance 571. The frequency at which the attenuation peak appears is lowered with an increase in the capacitance 571 as indicated by the broken line in FIG. 21, whereas the frequency referred to above increases with a decrease in the capacitance 571 as indicated by the alternate long and short dash line in FIG. 21. The output side also serves in the same manner as the input side. That is, the frequency at which the attenuation peak appears, varies based on the output-side capacitance which corresponds to the capacitance 571.

In the conventional transmission line filter referred to above, the capacitance 571 connected in series to the input-side resonator is determined only after the three capacitances 541, 551 and 552 are Δ-Y converted as shown in FIG. 20. Accordingly, the capacitance 571 is a function of the capacitances 541, 551 and 552. When it is desired to vary the capacitance 571, that is, to vary the frequency at which the peak of the attenuation appears, it is necessary to adjust all the capacitances 541, 551 and 552. Thus, the conventional transmission line filter involves a problem that only the capacitance 571 cannot be easily adjusted. For the output sade, a problem also arises in the same manner as referred to above.

Figure 22:
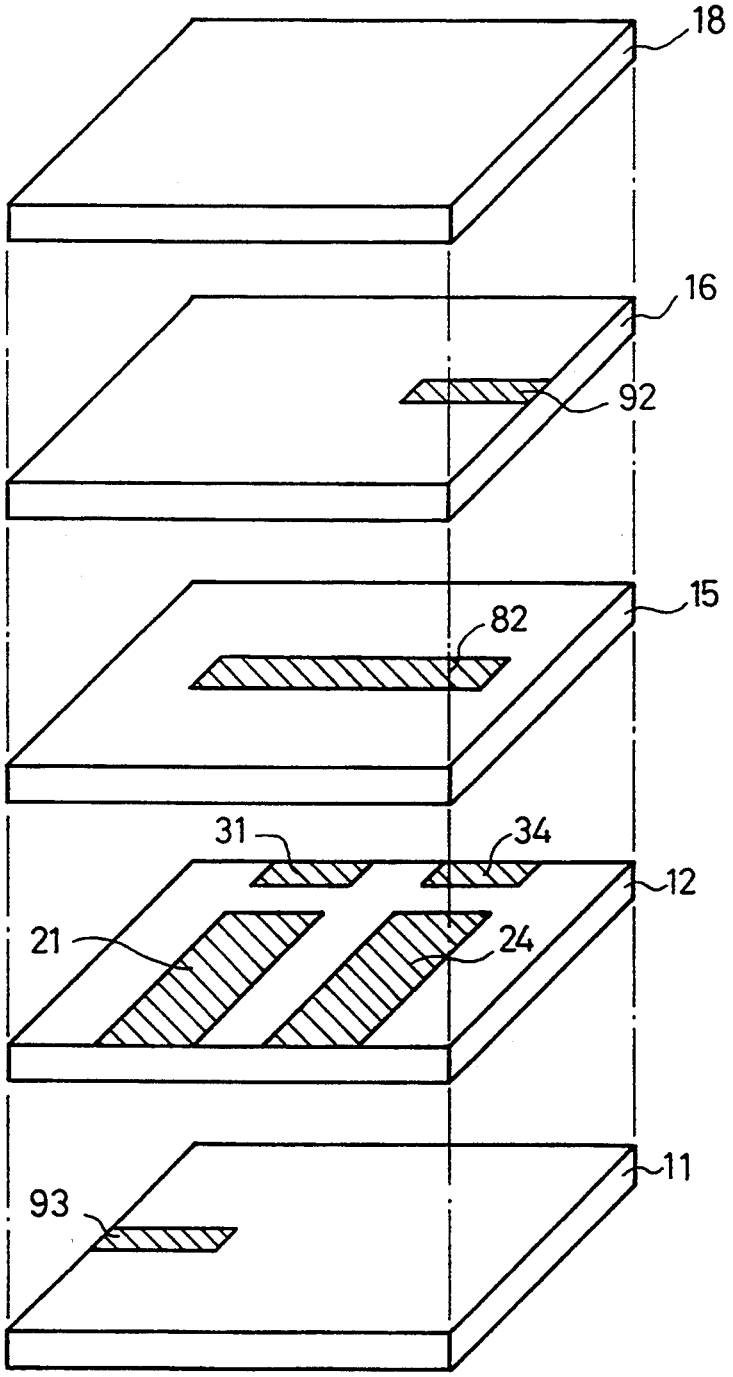
FIG. 22 is a schematic exploded perspective view showing a transmission line filter wherein the number of the resonators is reduced to be two in the second embodiment of the present invention.
Figure 23:
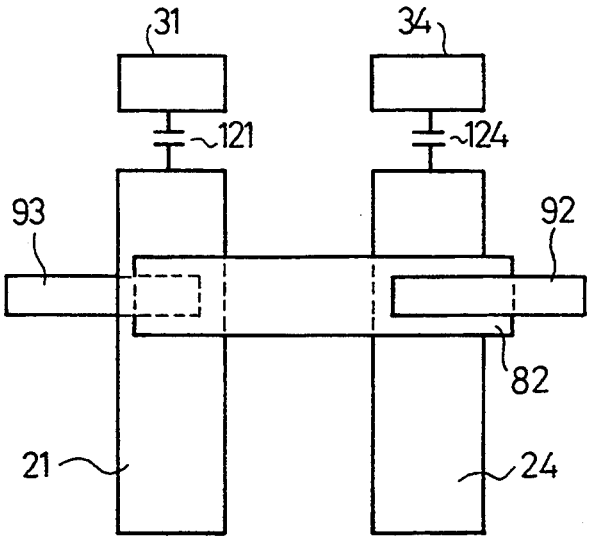
FIG. 23 is a schematic plan view showing the transmission line filter wherein the number of the resonators is reduced to be two in the second embodiment of the present invention.
Figure 24:
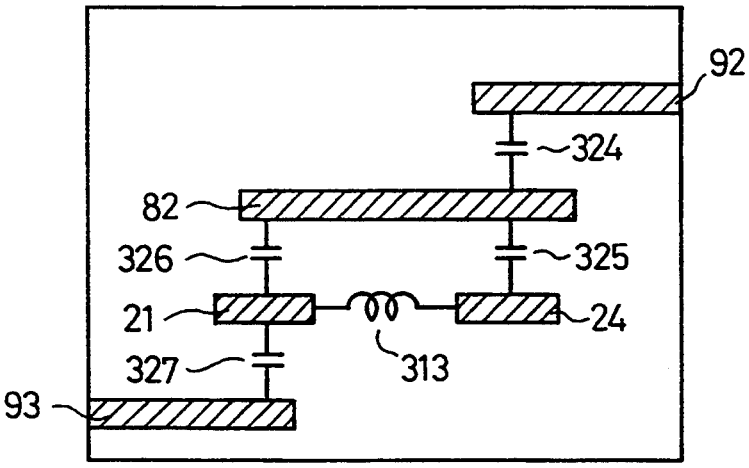
FIG. 24 is a cross-sectional view showing the transmission line filter wherein the number of the resonators is reduced to be two in the second embodiment of the present invention.
Figure 25:
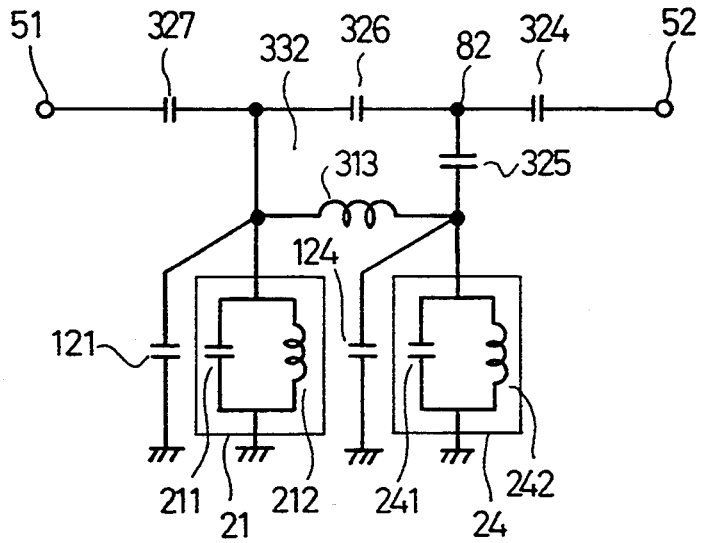
FIG. 25 is an equivalent circuit diagram of the transmission line filter wherein the number of the resonators is reduced to be two in the second embodiment of the present invention.
Figure 26:
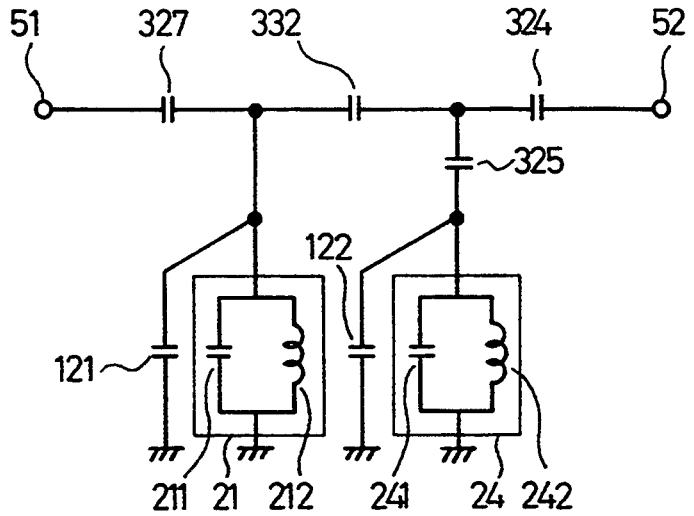
FIG. 26 is an equivalent circuit diagram of the circuit illustrated in FIG. 25.

The second embodiment, which has been described above, shows, as one example, the case where the four resonators are used. However, the number of the resonators may be either three or two. When the number of the resonators is two, a coupling electrode 82 may be disposed so as to overlap both an input-side resonator 21 and an output-side resonator 24 as illustrated in FIGS. 22, 23 and 24. Incidentally, an input electrode 93 is directly capacitively coupled with the input-side resonator 21. However, a coupling electrode may be further provided in a manner similar to the output side. In this case, an equivalent circuit is represented as shown in FIG. 25. An inductance 313 shown in FIG. 25 is absorbed by capacitances 326 and 325 so that the coupling between the resonators 21 and 24 is made capacitive. The resultant capacitance is represented as a capacitance 332 in FIG. 26. Also in this case, a capacitance 325 is equivalently coupled in series with the resonator 24. Therefore, the attenuation peak appears on the low-frequency side of the passband of a bandpass filter.

Furthermore, the attenuation peaks can be formed on the high- and low-frequency sides of the passband of the bandpass filter by applying the resonator structure according to the first embodiment to one of the input and output sides and by applying the resonator structure according to the second embodiment to the other of the input and output sides.

Having now fully described the invention, it will be apparent to those skilled in the art that many changes and modifications can be made without departing from the spirit or scope of the invention as set forth herein.

What is claimed is:

1. A transmission line filter, comprising:

a first ground electrode;

a dielectric layer disposed on said first ground electrode;

an input-side resonator disposed in said dielectric layer;

an output-side resonator disposed in said dielectric layer substantially adjacent to said input-side resonator, said output-side resonator being inductively coupled with said input-side resonator; and an input electrode and an output electrode coupled to said input-side and output-side resonators, respectively, at least one of said input and output electrodes being disposed in another dielectric layer in an opposed facing relationship both to a portion of said input-side resonator and to a portion of said output-side resonator, so as to overlap only said portions of input-side and output-side resonators.

2. A transmission line filter as recited in claim 1, wherein said input electrode and said output electrode are disposed in said another dielectric layer.

3. A transmission line filter as recited in claim 1, wherein said input-side resonator and said output-side resonator respectively have a first main surface and a second main surface, said first main surface is in an opposed relationship to said second main surface, said input electrode is disposed in an opposed facing relationship both to a portion of said first main surface of said input-side resonator and to a portion of said first main surface of said output-side resonator, and said output electrode is disposed in an opposed facing relationship both to a portion of said second main surface of said input-side resonator and to a portion of said second main surface of said output-side resonator.

4. A transmission line filter as recited in claim 1, wherein both said input and output electrodes are in opposed facing relationship to respective portions of both of said input-side and output-side resonators, a width of a portion of said input electrode which is in said opposed facing relationship to said portion of said output-side resonator is smaller than that of a portion of said input electrode which is in said opposed facing relationship to said portion of said input-side resonator, and a width of a portion of said output electrode which is in said opposed facing relationship to said portion of said input-side resonator is smaller than that of a portion of said output electrode which is in said opposed facing relationship to said portion of said output-side resonator.

5. A transmission line filter as recited in claim 3, wherein both said input and output electrodes are in opposed facing relationship to respective portions of both of said input-side and output-side resonators, a width of a portion of said input electrode which is in said opposed facing relationship to said portion of said output-side resonator is smaller than that of a portion of said input electrode which is in said opposed facing relationship to said portion of said input-side resonator, and the width of a portion of said output electrode which is in said opposed facing relationship to said portion of said input-side resonator is smaller than that of a portion of said output electrode which is in said opposed facing relationship to said portion of said output-side resonator.

6. A transmission line filter as recited in claim 1, further comprising a second ground electrode electrically connected to said first ground electrode and extending along said another dielectric layer.

7. A transmission line filter as recited in claim 3, further comprising a second ground electrode electrically connected to said first ground electrode and extending along said another dielectric layer.

8. A transmission line filter as recited in claim 4, further comprising a second ground electrode electrically connected to said first ground electrode and extending along said another dielectric layer.

9. A transmission line filter as recited in claim 5, further comprising a second ground electrode electrically connected to said first ground electrode and extending along said another dielectric layer.

10. A transmission line filter, comprising:

a first ground electrode;

a dielectric layer disposed on said first ground electrode;

an input-side resonator disposed in said dielectric layer;

an output-side resonator disposed in said dielectric layer;

at least one intermediate resonator disposed in said dielectric layer between said input-side resonator and said output-side resonator such that said input-side resonator, output-side resonator and said at least one intermediate resonator are disposed substantially adjacent to each other, the intermediate resonator nearest to said input-side resonator of said at least one intermediate resonator being inductively coupled with said input-side resonator, and the intermediate resonator nearest to said output-side resonator of said at least one intermediate resonator being inductively coupled with said output-side resonator; and an input electrode and an output electrode coupled to said input-side and output-side resonators, respectively, said input electrode being disposed in another dielectric layer in an opposed facing relationship both to a portion of said input-side resonator and to a portion of said intermediate resonator nearest to said input-side resonator so as to overlap only portions of said input-side resonator and said intermediate resonator nearest to said input-side resonator.

11. A transmission line filter as recited in claim 10, wherein both said input electrode and said output electrode are disposed in said another dielectric layer.

12. A transmission line filter as recited in claim 10, wherein said input-side resonator, said out-put-side resonator and said at least one intermediate resonator respectively have a first main surface and a second main surface, said first main surface is in an opposed relationship to said second main surface, one of said first main surface and said second main surface is disposed in an opposed facing relationship to said first ground electrode, said input electrode is disposed in an opposed facing relationship both to a portion of said first main surface of said input-side resonator and to a portion of said first main surface of said intermediate resonator nearest to said input-side resonator, and said output electrode is disposed in an opposed facing relationship both to a portion of said second main surface of said output-side resonator and to a portion of said second main surface of said intermediate resonator nearest to said output-side resonator.

13. A transmission line filter as recited in claim 10, wherein a width of a portion of said input electrode which is in said opposed facing relationship to said portion of said intermediate resonator nearest to said input-side resonator is smaller than that of a portion of said input electrode which is in said opposed facing relationship to said portion of said input-side resonator.

14. A transmission line filter as recited in claim 12, wherein a width of a portion of said input electrode which is in said opposed facing relationship to said portion of said intermediate resonator nearest to said input-side resonator is smaller than that of a portion of said input electrode which is in said opposed facing relationship to said portion of said input-side resonator.

15. A transmission line filter as recited in claim 10, further comprising a second ground electrode electrically connected to said first Ground electrode and extending along said another dielectric layer.

16. A transmission line filter as recited in claim 12, further comprising a second ground electrode electrically connected to said first ground electrode and extending along said another dielectric layer.

17. A transmission line filter as recited in claim 13, further comprising a second ground electrode electrically connected to said first ground electrode and extending along said another dielectric layer.

18. A transmission line filter, comprising:

a first ground electrode;

a dielectric layer disposed on said first ground electrode;

an input-side resonator disposed in said dielectric layer;

an output-side resonator disposed in said dielectric layer;

at least one intermediate resonator disposed in said dielectric layer between said input-side resonator and said output-side resonator such that said input-side resonator, said output-side resonator and said at least one intermediate resonator are disposed substantially adjacent one another, the intermediate resonator nearest to said input-side resonator of said at least one intermediate resonator being inductively coupled with said input-side resonator, and the intermediate resonator nearest to said output-side resonator of said at least one intermediate resonator being inductively coupled with said output-side resonator; and an input electrode and an output electrode coupled to said input-side and output-side resonators, respectively, wherein said output electrode is disposed in another dielectric layer in an opposed facing relationship both to a portion of said output-side resonator and to a portion of said intermediate resonator nearest to said output-side resonator so as to overlap only portions of both said output-side resonator and said intermediate resonator nearest to said output-side resonator.

19. A transmission line filter as recited in claim 18, wherein said input-side resonator, said output-side resonator and said at least one intermediate resonator respectively have a first main surface and a second main surface, said first main surface is in an opposed relationship to said second main surface, one of said first main surface and said second main surface is disposed in an opposed facing relationship to said first ground electrode, said input electrode is disposed in an opposed facing relationship both to a portion of said first main surface of said input-side resonator and to a portion of said first main surface of said intermediate resonator nearest to said input-side resonator, and said output electrode is disposed in an opposed facing relationship both to a portion of said second main surface of said output-side resonator and to a portion of said second main surface of said intermediate resonator nearest to said output-side resonator.

20. A transmission line filter as recited in claim 18, wherein a width of a portion of said output electrode which is in said opposed facing relationship to said portion of said intermediate resonator nearest to said output-side resonator is smaller than that of a portion of said output electrode which is in said opposed facing relationship to said portion of said output-side resonator.

21. A transmission line filter as recited in claim 19, wherein a width of a portion of said output electrode which is in said opposed facing relationship to said portion of said intermediate resonator nearest to said output-side resonator is smaller than that of a portion of said output electrode which is in said opposed facing relationship to said portion of said output-side resonator.

22. A transmission line filter as recited in claim 18, further comprising a second ground electrode electrically connected to said first ground electrode and extending along said another dielectric layer.

23. A transmission line filter as recited in claim 19, further comprising a second ground electrode electrically connected to said first ground electrode and extending along said another dielectric layer.

24. A transmission line filter as recited in claim 20, further comprising a second ground electrode electrically connected to said first ground electrode and extending along said another dielectric layer.

25. A transmission line filter as recited in claim 21, further comprising a second ground electrode electrically connected to said first ground electrode and extending along said another dielectric layer.

26. A transmission line filter as recited in claim 18, wherein both said input electrode and said output electrode are disposed in said another dielectric layer.

27. A transmission line filter as recited in claim 18, wherein both said input electrode and said output electrode are disposed in different dielectric layers.

28. A transmission line filter as recited in claim 18, wherein both said input electrode and said output electrode are disposed in different dielectric layers on opposite sides of said input-side resonator, said output-side resonator and said intermediate resonator.

29. A transmission line filter as recited in claim 1, wherein both said input electrode and said output electrode are disposed in different dielectric layers.

30. A transmission line filter as recited in claim 1, wherein both said input electrode and said output electrode are disposed in different dielectric layers on opposite sides of said input-side resonator and said output-side resonator.

31. A transmission line filter as recited in claim 10, wherein both said input electrode and said output electrode are disposed in different dielectric layers.

32. A transmission line filter as recited in claim 10, wherein both said input electrode and said output electrode are disposed in different dielectric layers on opposite sides of said input-side resonator, said output-side resonator and said intermediate resonator.

33. The transmission line filter of claim 10, wherein said at least one intermediate resonator consists of a single intermediate resonator, such that said intermediate resonator nearest to said input-side resonator and said intermediate resonator nearest to said output-side resonator are the same intermediate resonator.

34. The transmission line filter of claim 18, wherein said at least one intermediate resonator consists of a single intermediate resonator, such that said intermediate resonator nearest to said input-side resonator and said intermediate resonator nearest to said output-side resonator are the same intermediate resonator.

* * * * *

UNITED STATES PATENT AND TRADEMARK OFFICE

CERTIFICATE OF CORRECTION

PATENT NO. : 5,412,358

DATED : May 2, 1995

INVENTOR(S) : Takami Hirai and Shinsuke Yano

It is certified that error appears in the above-indentified patent and that said Letters Patent is hereby corrected as shown below:

IN THE DRAWINGS

Please add new sheet 19 depicting Fig. 27 as shown on the attached page.

Signed and Sealed this

Eighteenth Day of March, 1997

*Attest:*

*Attesting Officer*

Bruce Lehman

BRUCE LEHMAN

*Commissioner of Patents and Trademarks*

UNITED STATES PATENT AND TRADEMARK OFFICE

CERTIFICATE OF CORRECTION

PATENT NO. : 5,412,358

DATED : May 2, 1995

INVENTOR(S) : Takami Hirai and Shinsuke Yano

It is certified that error appears in the above-indentified patent and that said Letters Patent is hereby corrected as shown below:

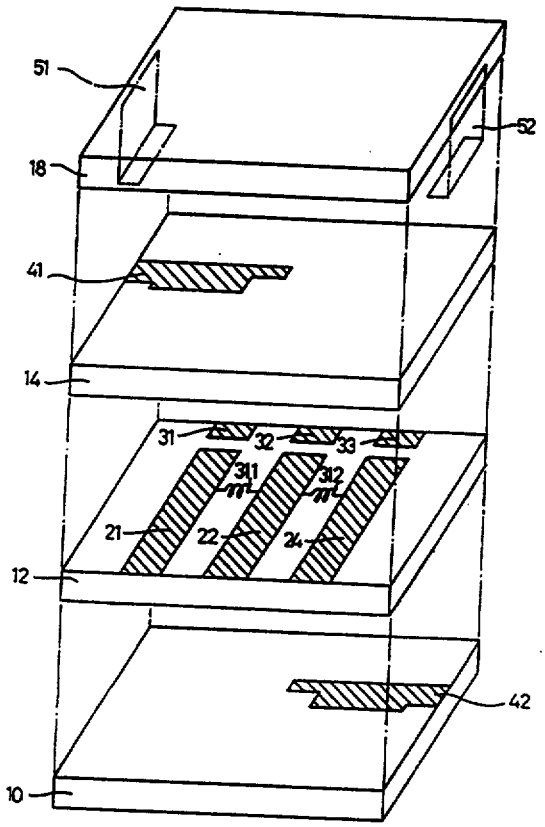

FIG.27